United States Patent [19]

Gabelman

[11] 4,339,195

[45] Jul. 13, 1982

[54] ELECTROPHOTOCOPIER ROLLER ASSEMBLY

[75] Inventor: George N. Gabelman, Ridgefield, Conn.

[73] Assignee: Pitney Bowes Inc., Stamford, Conn.

[21] Appl. No.: 207,180

[22] Filed: Nov. 17, 1980

[51] Int. Cl.[3] ..... G03G 15/02; G03G 15/16

[52] U.S. Cl. ..... 355/3 CH; 250/324; 250/325; 355/3 TR; 355/15

[58] Field of Search ..... 355/3 CH, 15, 3 TR; 118/652; 15/256.51, 256.52; 250/324–326

[56] References Cited

U.S. PATENT DOCUMENTS 4,028,551 6/1977 Thompson ..... 250/324 X 4,056,723 11/1977 Springett et al. ..... 250/326 X

*Primary Examiner*—Richard L. Moses

*Attorney, Agent, or Firm*—Lawrence E. Sklar; Martin D. Wittstein; William D. Soltow, Jr.

[57] ABSTRACT

An improvement in an electrophotocopying machine having a photosensitive member. The improvement includes at least two rollers for charging the photosensitive member or at least two rollers for transferring a toned image from the photosensitive member to a plain copy sheet. The rollers are mounted on a turret adjacent the photosensitive member. The improvement also includes a mechanism for rotating one of the rollers into its operating position adjacent the photosensitive member and the other of the rollers into a cleaning position removed from the photosensitive member, and a cleaning device for cleaning the other roller in its cleaning position.

7 Claims, 1 Drawing Figure

ELECTROPHOTOCOPIER ROLLER ASSEMBLY

BACKGROUND OF THE INVENTION

The present invention relates to electrophotocopiers, and more particularly to cleaning charging and transfer rollers used in electrophotocopiers.

In conventional electrophotography, a photoconductor is electrostatically charged uniformly over its surface and is exposed to a light pattern of the image being reproduced to thereby discharge the charge in the areas of the photoconductor. The undischarged areas of the photoconductor thus form an electrostatic charge pattern in conformity with the configuration of the original light pattern. The latent electrostatic image may then be developed by contacting it with a finely divided, electrostatically attractable toner material, such as a resinous powder. The toner is held in the image areas by the electrostatic fields on the photoconductor. Where the field is greatest, the greatest amount of toner is deposited, and where the field is least, little or no toner is deposited. Thus, a toned image is produced in conformity with the latent electrostatic image. The toner is subsequently transferred to a sheet of plain paper or other surface and suitably affixed to thereby form a permanent print.

The toner may be fixed by passing the sheet of paper or other surface including the toned image between a heated roller and a second roller in pressure contact therewith whereby the toner becomes fused to the sheet of paper.

The toned image is generally transferred to a plain paper copy sheet by passing the copy sheet between the photoconductor including the toned image and a charged, transfer roller in contact therewith. The transfer roller is charged electrically opposite that of the toner, but with a greater potential than that of the photoconductor so that the toner particles are attracted towards the roller. Thus, when a copy sheet is interposed between the roller and the toner covered photoconductor, the toner particles, being attracted by the charged transfer roller, are transferred to the copy sheet.

In the event a copy sheet is not passed between the charged transfer roller and the photoconductor after the image on the photoconductor has been developed, the residual toner particles on the photoconductor will be transferred nevertheless, but now instead of to the copy sheet, to the transfer roller. As a result, a buildup of toner particles on the transfer roller occurs, causing the back surfaces of subsequently passed copy sheets to be smeared with toner from the transfer roller. A similar problem is encountered with the charging roller, which also becomes contaminated with toner particles which are not removed by the cleaning system for the photoconductor.

The instant invention therefore provides a multiple roller assembly wherein charging or transfer rollers can be moved in and out of operational and functional positions to facilitate cleaning of one roller while another roller performs its operational function, thereby overcoming the foregoing problems.

SUMMARY OF THE INVENTION

The instant invention is an improvement in an electrophotocopying machine having a photosensitive member. The improvement comprises at least two rollers for charging said photosensitive member or at least two rollers for transferring a toned image from the photosensitive member to a plain copy sheet, the rollers being mounted on a turret adjacent the photosensitive member, means for rotating one of the rollers into its operating position adjacent the photosensitive member and the other of the rollers into a cleaning position removed from the photosensitive member, and means for cleaning the other roller in its cleaning position.

DETAILED DESCRIPTION

Figure 1:
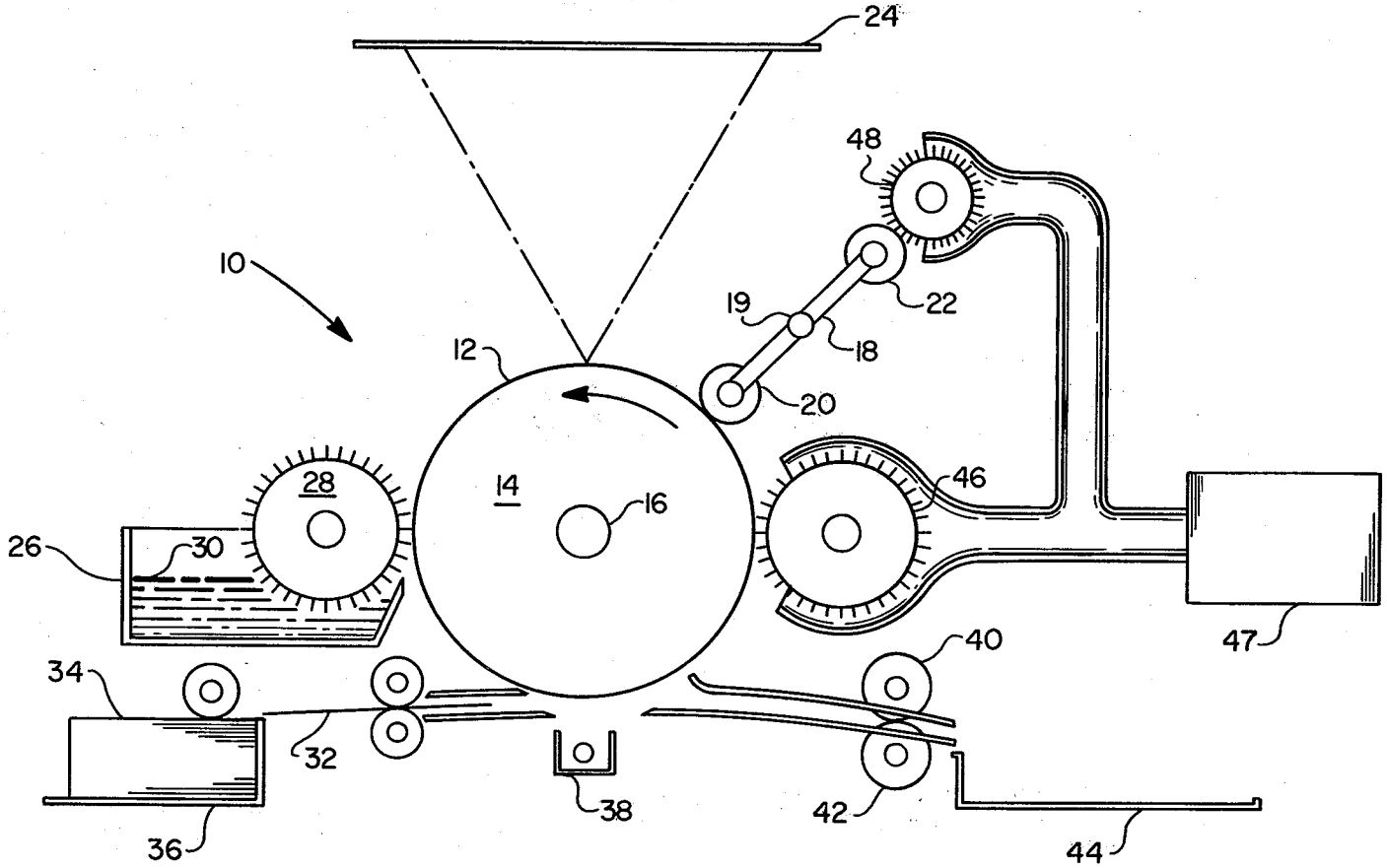
FIG. 1 is a side, elevational view in schematic form of a charger roller assembly in an electrophotocopying machine according to the instant invention.

In describing the preferred embodiment of the instant invention, reference is made to the drawing, wherein the basic components of a plain paper photocopying machine generally designated 10 are shown. The photocopying machine 10 includes a re-usable photoconductor 12 secured to a drum 14 mounted on a shaft 16. Situated around the photoconductor 12 are a number of operating stations. At about the 2 o'clock position is situated a turret generally designated 18 rotatably supporting at either end thereof a pair of charging rollers 20 and 22 (to be described in further detail hereinafter). The turret 18 is rotatably mounted on a shaft 19. The original document to be copied (not shown) rests upon a transparent platen 24 and is preferably scan exposed upon the 12 o'clock portion of the photoconductor 12 in conventional manner to thereby form a latent electrostatic image on the charged photoconductor. A developer device 26 is located at a 9 o'clock position with respect to the photoconductor 12, and includes a magnetic brush 28 for applying toner material 30 to the latent electrostatic image on the photoconductor 12.

A copy sheet 32 is fed from a supply of copy sheets 34 stored in a feeding tray 36 towards a transfer corona 38 which functions to transfer the developed image from the photoconductor 12 to the copy sheet 32 in conventional manner. The copy sheet 32 bearing the toned image is then fed to a pair of pressure fixing rollers 40 and 42 which fuse the toned image in conventional manner to the copy sheet 32. The copy sheet 32 then exits into a receiving tray 44 where it may be retrieved by the operator. Prior to the next copy cycle, the photoconductor 12 is cleaned by a conventional, continuous wiping roller 46 operatively associated with a vacuum device 47.

As mentioned hereinabove, the turret 18 rotatably supports a charging roller 20 at one end and another charging roller 22 at the other end. As seen in FIG. 1, the charging roller 20 is situated in an operational position adjacent the photoconductor 12, while the other charging roller 22 is situated in a position facilitating cleaning of the roller 22 by a biased wire brush 48 also operatively associated with the vacuum device 47. If, by way of example, the charging roller 20 is biased positive in order to positively charge the photoconductor in order that the photoconductor may attract electrostatically attractable toner material, then the bias on the roller 22 in the cleaning position would be reversed to negative in order that the toner material not be attracted to the roller 22 and that toner be transferred to the wire brush 48 which is positively charged.

Electrical contact to the charging rollers 20 and 22 may be effected through the shaft 19, and the same contact is used to reverse the bias on the charging roller being cleaned. The rollers 20 and 22 may be rotated to and from the charging and cleaning positions by any means, including a solenoid, a stepping motor, pawls on a drive chain, etc.

The charging rollers can be cleaned any time after charging of the photoconductor 12. In one mode, for example, the photoconductor 12 is charged positively by the charging roller 20, after which the turret 18 is rotated so that the roller 20 occupies the position shown for the roller 22. The bias voltage is then reversed and the roller 20 is then rotated in wiping contact with the positively biased wire brush 48 which attracts the loosely adhering toner material from the roller 20. When the turret 18 is rotated, of course the cleaned charging roller 22 is rotated into its operational position ready to charge the photoconductor 12 on its next copy cycle. In another mode, the turret 18 could be arranged so that the charging roller 20 was used to charge the photoconductor 12 a certain number of cycles, after which it would be rotated into the cleaning position.

Although the rollers shown and described are charging rollers, the same type of a turret assembly may also be employed for transfer rollers in an electrophotocopying machine. Also, although two rollers are shown and described, the assembly could include three or more, depending on operational constraints.

While the present invention has been described with reference to the particular structure disclosed herein, it is not intended that it be limited to the specific details and this application is intended to cover such modifications or changes as may come within the purposes of the improvements or scope of the claims forming a part hereof.

What is claimed is:

1. In an electrophotocopying machine having a photosensitive member, the improvement comprising at least two rollers operatively associated with said photosensitive member, said rollers being mounted on a turret adjacent the photosensitive member, means for rotating one of said rollers into its operating position adjacent said photosensitive member and the other of said rollers into a cleaning position removed from said photosensitive member, and means for cleaning said other roller in its cleaning position.

2. The improvement of claim 1, wherein the cleaning means comprises a biased wire brush.

3. The improvement of claim 2, wherein the photosensitive member comprises a reusable photoconductor.

4. The improvement of claim 3, additionally comprising a vacuum device operatively associated with said biased wire brush.

5. The improvement of claim 4, wherein said rotating means comprises a solenoid.

6. The improvement of claim 1, wherein said rollers comprise charging rollers for charging said photosensitive member.

7. The improvement of claim 1, wherein said rollers comprise transfer rollers for transfering a toned image from the photosensitive member to a plain copy sheet.

* * * * *